US005742215A

United States Patent [19]

Park

[11] Patent Number: 5,742,215

[45] Date of Patent: Apr. 21, 1998

[54] TRANSMISSION LINE FILTER HAVING A SWITCHING FUNCTION

[75] Inventor: Joung-Kyou Park, Seoul, Rep. of Korea

[73] Assignee: Samsung Electronics Co., Ltd., Kyungki-do, Rep. of Korea

[21] Appl. No.: 684,245

[22] Filed: Jul. 19, 1996

[30] Foreign Application Priority Data

Jul. 21, 1995 [KR] Rep. of Korea ..... 21625/1995

[51] Int. Cl.[6] ..... H01P 1/203; H01P 1/10

[52] U.S. Cl. ..... 333/204; 333/128; 333/219; 333/202; 333/262

[58] Field of Search ..... 333/126–129, 333/134, 204, 205, 219, 235, 262

[56] References Cited

U.S. PATENT DOCUMENTS

| | | | |
|---|---|---|---|
| 4,267,538 | 5/1981 | Assal et al. | 333/262 |
| 4,835,499 | 5/1989 | Pickett | 333/235 X |
| 4,980,660 | 12/1990 | Nakamura et al. | 333/207 X |
| 5,023,935 | 6/1991 | Vancraeynest | 333/134 X |
| 5,109,205 | 4/1992 | Hart et al. | 333/262 X |
| 5,272,457 | 12/1993 | Heckaman et al. | 333/262 |
| 5,387,886 | 2/1995 | Takalo et al. | 333/134 X |
| 5,521,561 | 5/1996 | Yrjölä et al. | 333/104 X |
| 5,625,894 | 4/1997 | Jou | 455/78 |

*Primary Examiner*—Robert Pascal
*Assistant Examiner*—Barbara Summons
*Attorney, Agent, or Firm*—Dilworth & Barrese

[57] ABSTRACT

A strip line filter has a switching function for being operated without connecting a separate switch to a front end and a back end of the filter for preventing transmission electric power from being lost by a receiving unit, to thereby make the size of the transmitting and receiving system smaller. The strip line filter has a switching function in a transmission line filter, comprising: an inputting unit resonator and an outputting unit resonator, with the inputting unit resonator having a first open stub and a second open stub with the first open stub connected to ground through at least one capacitor; and the outputting unit resonator has a third open stub and a fourth open stub with the third open stub connected to ground through at least one capacitor, and being positioned within a distance of about one wavelength of a pass band frequency from the inputting unit resonator.

21 Claims, 2 Drawing Sheets

TRANSMISSION LINE FILTER HAVING A SWITCHING FUNCTION

BACKGROUND OF THE INVENTION

1. Field of the Invention

The present invention relates to a transmission line filter, and more particularly to a strip line filter having a switching function.

A strip line filter having a switching function according to the present invention is based on Korean Application No. 21625/95 which is incorporated herein by reference.

2. Description of the Related Art

In the prior art, when a strip line or a micro strip line filter utilizing a distributed element is used in a transmitting/receiving system, a separate switch should be utilized internal to the transmitting/receiving system to prevent some of the transmission power from being lost by a receiving unit. Thus, in the case that the switch is provided to a front end or a back end of the filter, the size of the transmitting/receiving system is unnecessarily increased.

Also, in the case of the prior art strip line filters, a resonator consisting of the strip line has been geometrically fixed, and in the case of a band pass filter, there have been disadvantages in which the size of the band pass filter is fixed because a center frequency of the band pass filter is determined according to a length and a width of the strip line and hence it is difficult to move or eliminate a center frequency.

Also, in the case that a diode or a varactor diode is utilized in the strip line or the strip line filter, there has been a problem that one side of the resonator should be necessarily made short. The following are examples illustrating the above problem.

FIG. 1 is a view illustrating a construction of a prior art micro strip line filter. FIG. 2 is a view illustrating a construction of the transmitting/receiving unit utilizing the prior art micro strip line filter. Each of open stubs 101 and 103 is equivalent to a capacitor, and each of short stubs 102 and 104 is equivalent to an inductor, in which stubs 101,102 form a first resonator, and stubs 103, 104 form a second resonator. Also, a slit 105 between the first and second resonators generates a coupling capacitance. Therefore, the center frequency, the pass bandwidth and any ripple can be controlled by controlling the lengths of the open stubs 101 and 103, the lengths of the short stubs 102 and 104, and the interval of the slit 105. In other words, if the lengths of the open stubs 101 and 103 and the short stubs 102 and 104 are reduced, the center frequency is increased. In addition, as the width of the resonator is increased, the bandwidth is reduced. Furthermore, as the interval of the slit 105 is varied, the degree of the ripple is varied.

Also, in the case of a transmitting/receiving system in which a channel should be selected or to which the transmitting unit and the receiving unit are provided, as shown in FIG. 2, the separate switch 201 is required for connecting an antenna 200 with the receiving unit 203 for reception through filter 202 and connecting the antenna 200 with the transmitting unit 205 for transmission through filter 202. In one embodiment, the receiving unit 203 is an LNA below receiving unit, and the transmitting unit 205 is a power amplifier below transmitting unit.

Various forms and applications of micro strip filters have previously been proposed. For example, U.S. Pat. No. 4,806,890 discusses a tunable microwave filter having a controllable center frequency and a varactor diode connected in series between stubs.

U.S. Pat. No. 5,138,288 discloses a micro strip filter having a varactor coupled between two micro strip line resonators. The micro strip filter has an in-series connecting sequence of a first strip line resonator, a varactor diode and a second strip line resonator, and performs the function of changing frequency filtering shape.

A Korean patent publication No. 3343 for "a frequency controlling method of a micro strip line resonator" filed on Sep. 21, 1989 by Taebong Electronics, Ltd. discloses a method for controlling a resonant frequency of a strip line resonator. A circuit for implementing the frequency controlling method connects a varactor diode in parallel with a strip line for an RF choke and in parallel to a short stub which is series-connected to a capacitor.

European Pat. No. 0,552,701 A2 discloses a package for a microwave device. The disclosed package circuit prevents an electrostatic breakdown phenomenon of a microwave part. A circuit in the package connects in series a $\lambda/4$ strip line with a diode connected to ground.

An attenuator having the construction of a connecting sequence of an inductor, an RF choke, a strip line, and a grounded diode has also been discussed in a report published by the Hewlett Packard Company.

As discussed above, the constructions and the operations of the prior art are various, but there have been problems to be solved in the operation and the size of transmitting and receiving systems employing the above described features.

SUMMARY OF THE INVENTION

It is therefore an object of the present invention to provide a strip line filter having a switching function for being operated without connecting to a front end and a back end of the filter a separate switch for preventing transmission electric power from being lost by a receiving unit, to thereby make the transmitting and receiving system smaller in size.

It is another object of the present invention to provide a strip line filter having a switching function for easily moving or eliminating a center frequency.

It is further another object of the present invention to provide a strip line filter having a switching function in which a short stub is not utilized.

To achieve these and other objects, the present invention provides a strip line filter having a switching function in a transmission line filter, comprising: an inputting unit resonator and an outputting unit resonator, the inputting unit resonator having a first open stub connected to a second open stub, with the first open stub grounded through at least one capacitor; and the outputting unit resonator having a third open stub connected to a fourth open stub, with the third open stub grounded through at least one capacitor, and being positioned within a distance of one wavelength of a pass band frequency from the inputting unit resonator.

BRIEF DESCRIPTION OF THE DRAWINGS

The following is a detailed description of the invention with reference to the attached drawings, in which like numbers indicate the same or similar elements.

DETAILED DESCRIPTION OF PREFERRED EMBODIMENTS

In the following description, many specific terms or elements of illustrative circuits are shown to provide more comprehensive understanding of the present invention, but it is evident that the person having ordinary skill in a the art can practice the present invention without such specific terms. A more detailed description for related known functions or constructions is omitted in order to avoid unnecessarily obscuring the subject matter of the present invention.

Figure 3:
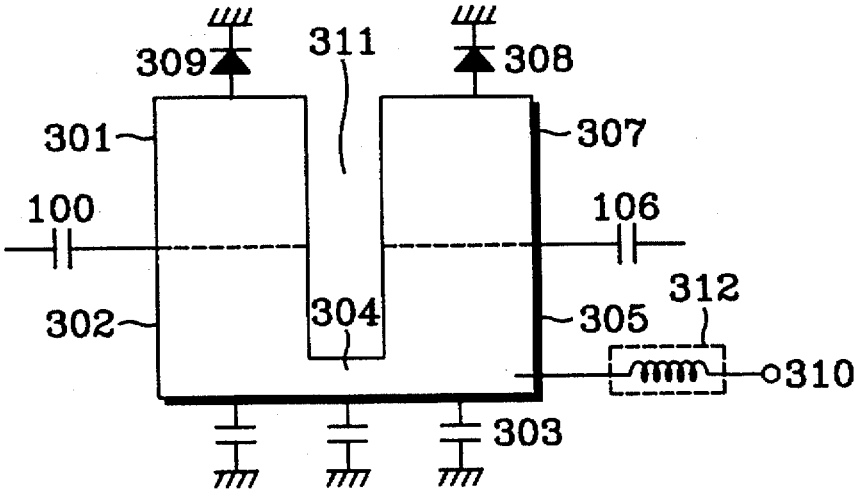
FIG. 3 illustrates a strip line filter having a switching function according to the present invention.
Figure 2:
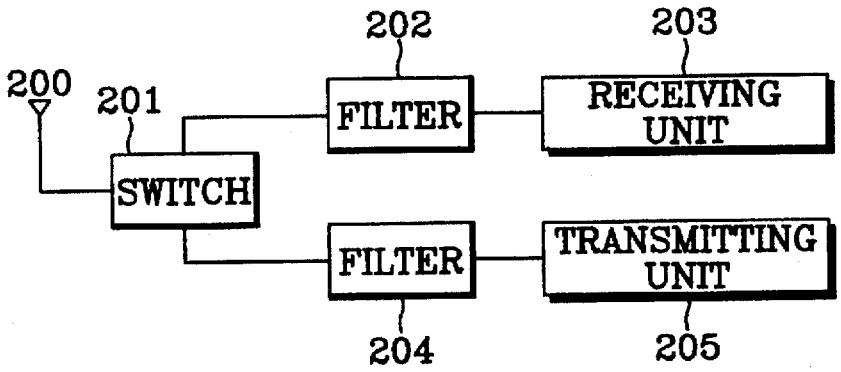
Fig. 2 (PRIOR ART)
FIG. 2 illustrates a prior art transmitting and receiving unit utilizing a prior art micro strip line filter.

FIG. 3 is a diagram illustrating a strip line filter having a switching function according to the present invention. The strip line filter comprises resonators consisting of strip lines 301, 302, 305 and 307; a region 304; an inputting unit and outputting unit 100 and 106; respectively; an RF choke 312 (or alternatively a $\lambda/4$ transformer or a diode bias) for driving diodes 308,309; a control terminal 310; capacitor 303 for blocking direct current (DC) and passing alternating current (AC) with respect to stubs 302, 305. In alternative embodiments, each of diodes 308, 309 may be replaced by various diodes such as varactor diodes, or by transistors such as field effect transistors.

Figure 1:
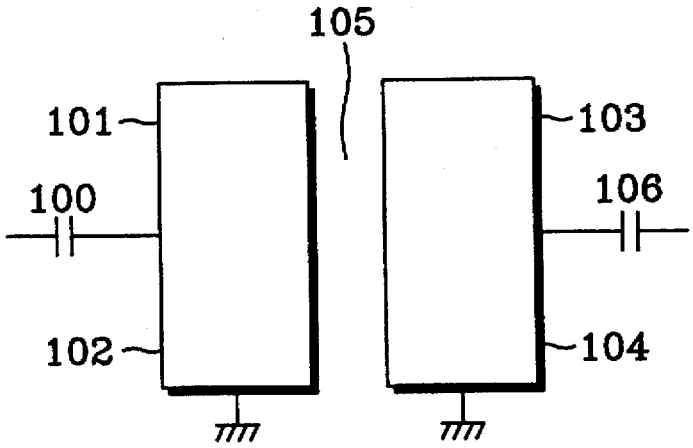
Fig. 1 (PRIOR ART)
FIG. 1 illustrates a prior art micro strip line filter.

As shown in FIG. 3, the diodes 308 309 are connected to the open stubs 307 and 301 respectively, thereby to eliminate the pass band a characteristic of the strip line filter. When the diodes are turned on, the open stubs 307 and 301 act as short stubs, the characteristics of the pass band filter are eliminated, and a circuit between the inputting unit 100 and the outputting unit 106 is turned off, causing an open circuit between an input end and an output end. In the above described FIG. 1, if the diodes are connected to the open stubs 101 and 103, a bias voltage cannot be applied to the open stubs 101 and 103 because of the short stubs 102 and 104.

Also, in order to maintain the characteristic of the short stub, at least one capacitor 303 is connected to each of the stubs 302 and 305 as shown in FIG. 3 for blocking the DC to ground.

On the other hand, in the case that the diodes 308 and 309 are respectively connected to the resonators, the RF choke 312 (or alternatively the $\lambda/4$ transformer or the bias circuit) for supplying the DC should be respectively utilized. Therefore, the region 304 provides an input/output feed to opposite portions of the stubs 302 and 305, thereby to simultaneously control the diodes 308 and 309 connected to the two resonators by one control terminal. Preferably, stubs 302 and 305 are positioned within a distance of about one wavelength of a pass band frequency.

Figure 4:
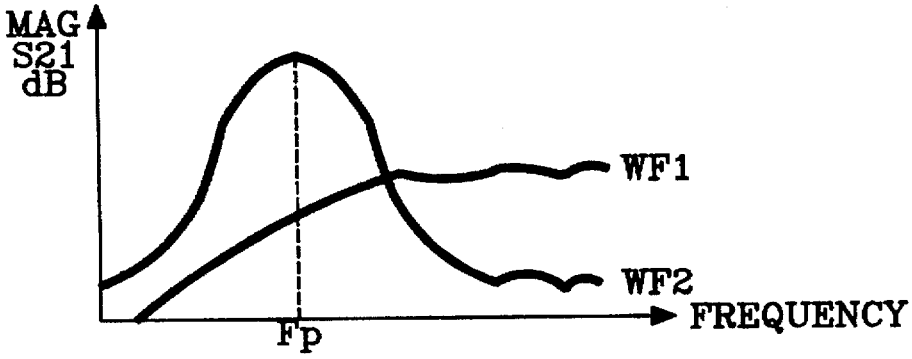
FIG. 4 illustrates a characteristic diagram of the performance of a strip line filter having a switching function according to the present invention.

FIG. 4 is a view illustrating a characteristic diagram of the strip line filter having a switching function according to the present invention. As shown in FIG. 4, Fp indicates the center frequency of the band pass filter. Also, WF1 indicates a waveform in the case that the two diodes 308 and 309 are turned on, and WF2 indicates the waveform in the case that the two diodes 308 and 309 are turned off.

Figure 5:
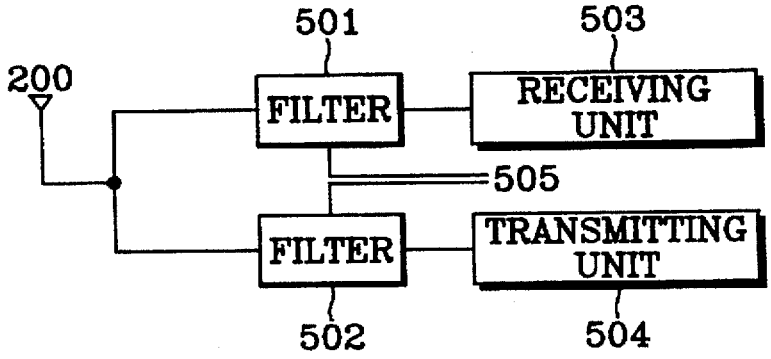
FIG. 5 illustrates a transmitting unit and a receiving unit utilizing a strip line filter having a switching function according to the present invention.

FIG. 5 is a view illustrating a construction of the transmitting and receiving unit utilizing the strip line filter having the switching function according to the present invention. At least one switching filter 501,502 is respectively utilized in the transmitting unit and the receiving unit, and the directions of the diodes provided internal to the switching filters 501 and 502 are respectively different, such that opposite signals are applied to the switching filters 501 and 502 through the switching control terminal 505. So during transmission, the transmitting filter 502 is turned on so that the antenna 200 is connected to the transmitting unit 504, thereby to make possible the transmitting operation. During transmission, the receiving unit 503 is protected by turning off the receiving filter 501. Also, during reception, the receiving filter 501 is turned on so that the antenna 200 is connected to the receiving unit 503, thereby to make possible the receiving operation. During reception, the transmitting unit 504 and the receiving unit 503 may avoid leakage transmittance noise by turning off the transmitting filter 502.

Also, in the case that the strip line filter according to the present invention is utilized for selecting a channel, at least one filter per one channel is used such as shown in FIG. 5, and the length or a thickness of the stubs 301,302, 307 and 305, the interval of the slit 311 and a capacitance value of the capacitors 303 (FIG. 3) are controlled or selected in order to adapt the center frequency of the filter to each channel. For the embodiment shown in FIG. 5, the channel is selected by the control terminal 505 in the same manner that the transmitting unit 504 or the receiving unit 503 is selected.

Advantageously, the strip line filter according to the present invention includes the simpler and more effective construction of the diodes 308, 309 (FIG. 3) being respectively positioned at one side of two strip lines, and preferably not between two strip lines. Also, the diodes 308,309 of the embodiment according to the present invention are not limited to the use of varactor diodes. Further, the diodes 308,309 need not be connected in series between two resonators but may be connected to ground, and a groundhole may not have to be utilized. The embodiment of the present invention performs a filtering through the strip line and has the construction in which two strip lines may be positioned substantially far away from each other. Therefore, a package is not required.

As discussed, the strip line filter according to the present invention has an advantage in which the strip line filter further comprises the diode, and the characteristic of the distributed element of the strip line is varied in response to turn-on or turn-off of the respective diodes 308, 309 to perform the switching function, so that the switching speed is dependent upon the diode characteristics and the strip line is utilized as a landing pad for the diodes 308,309, thereby to make the system size smaller.

Also, the strip line filter has an advantage in which the open stubs provided with the respective diodes are operated such as the respective short stubs, so that the characteristic of the pass band is entirely transformed according to turn-on or turn-off of the respective diodes, thereby to obtain a large insertion loss when the characteristic of the switch-off is utilized.

Also, the strip line filter has an advantage in which each respective resonator is made open in DC and the respective diode is connected to the ground in series, thereby to eliminate the necessity of the respective short stub.

While them have been illustrated and described what are considered to be preferred embodiments of the present invention, it will be understood by those skilled in the art that various changes and modifications may be made, and equivalents may be substituted for elements thereof without departing from the scope of the present invention.

What is claimed is:

1. A transmission line filter having a switching function, comprising: an inputting unit resonator and an outputting unit resonator, said inputting unit resonator having a conducting strip connected to receive an input signal at a first portion thereof, a first open stub on a first side of said first portion, a second open stub on a second side of said first portion opposite said first side, with said first open stub connected to ground through at least one capacitor;

said outputting unit resonator having a conducting strip with a first section connected to provide an output signal, a third open stub on a first side of said first section and a fourth open stub on a second side of said first section, said third open stub is connected to ground through at least one capacitor;

said filter further comprising:

(i) a central conducting strip connecting said inputting unit resonator to said outputting unit resonator such that said inputting unit resonator, said central conducting strip and said outputting unit resonator together form a continuous conducting path;

(ii) a first switch coupled between said second open stub and ground;

(iii) a second switch coupled between said fourth open stub and ground; and (iv) means for selectively applying a DC bias to said switches to selectively turn said switches on or off; wherein when said switches are in a first switching state, the transmission line filter acts as a bandpass filter and when said switches are in a second switching state, said transmission line filter exhibits a high insertion loss in a passband of the bandpass filter.

2. The transmission line filter as claimed in claim 1, wherein each said switch is one of a diode and a transistor.

3. The transmission line filter as claimed in claim 1, wherein each said switch is a field effect transistor.

4. The transmission line filter as claimed in claim 1, wherein each said switch is a diode.

5. The transmission line filter as claimed in claim 1, wherein each said switch is a varactor diode.

6. The transmission line filter as claimed in claim 1, wherein said inputting unit resonator further includes an input terminal and said outputting unit resonator further includes an output terminal, wherein said input and output terminals are connected to a direct current blocking capacitor.

7. The transmission line filter as claimed in claim 6, further comprising a control terminal connected to a $\lambda/4$ transformer.

8. The transmission line filter as claimed in claim 6, wherein said means for applying a DC bias comprises a control terminal connected to a bias circuit for a diode.

9. The transmission line filter as claimed in claim 6, wherein the blocking capacitor is connected to a control terminal.

10. The transmission line filter as claimed in claim 6, wherein said means for applying a DC bias comprises a control terminal connected to a radio frequency choke.

11. A radio transmitting and receiving device, comprising:

an antenna;

a transmitting unit for transmitting radio signals; a transmitting filter that selectively acts as either a bandpass filter or a high insertion loss device;

a receiving unit for receiving the radio signals; a receiving filter that selectively operates either as a bandpass filter or a high insertion loss device;

wherein said transmitting filter and said receiving filter each comprise:

an inputting resonator having a conducting strip connected to receive an input signal at a first portion thereof, a first open stub on a first side of said first portion, a second open stub on a second side of said first portion opposite said first side, with said first open stub connected to ground through at least one capacitor;

an outputting resonator having a conducting strip with a first section connected to provide an output signal, a third open stub on a first side of said first section and a fourth open stub on a second side of said first section, said third open stub being connected to ground through at least one capacitor;

a central conducting strip connecting said inputting unit resonator to said outputting unit resonator such that said inputting unit resonator, said central conducting strip and said output unit resonator together form a continuous conducting strip;

a first switch coupled between said second open stub and ground;

a second switch coupled between said fourth open stub and ground;

means for selectively applying a DC bias to said switches to selectively turn said switches on or off;

wherein when said switches of said transmission line filter are in a first switching state, the transmission line filter acts as a bandpass filter, and when said switches are in a second switching state, the transmission line filter exhibits a high insertion loss in a passband of said bandpass filter;

said device further comprising control means for controlling said DC bias such that said transmitting filter acts as a bandpass filter while said receiving filter acts as a high insertion loss device, and said receiving filter acts as a bandpass filter while said transmitting filter acts as a high insertion loss device.

12. The radio transmitting and receiving device of claim 11, wherein said switches comprise diodes, connections of said diodes are opposite to each other in said transmitting unit and said receiving unit, such that a common bias control signal applied to said transmitting and receiving filters causes one of said transmitting and receiving filters to act as a filter while the other acts as a high insertion loss device.

13. The radio transmitting and receiving device of claim 11, wherein an input of said receiving filter is connected to an output of said transmitting filter.

14. The radio transmitting and receiving device as claimed in claim 11, wherein the transmitting and receiving filters are connected between said antenna and said transmitting and receiving unit.

15. The radio transmitting and receiving device as claimed in claim 11, wherein the transmitting and receiving filters have different center frequencies of respective passbands thereof.

16. A transmission line filter having a switching function, including a transmission line having an inner strip conductor and at least one ground plane spaced from the inner strip conductor, the transmission line filter comprising:

said inner strip conductor having an electrically continuous structure comprising an input strip of a first width, a central strip of a second width substantially less than said first width, and an output strip of substantially said first width, wherein said first strip is connected to receive an input signal and said output strip is connected to provide an output signal;

a first switch coupled between a first side of said input strip and ground;

a second switch coupled between a first side of said output strip and ground;

a first capacitor coupled between a second side of said first strip and ground;

a second capacitor coupled between a second side of said output strip and ground;

means for selectively applying a DC bias to said switches to selectively turn said switches on or off;

wherein when said switches are in a first switching state, the transmission line filter acts as a bandpass filter and when said switches are in a second switching state, said transmission line filter exhibits a high insertion loss in a passband of the bandpass filter.

17. The filter of claim 16 wherein said DC bias is applied to said continuous inner strip conductor via an RF choke.

18. The filter of claim 16 wherein said transmission line comprises a microstrip transmission line.

19. The filter of claim 16 further comprising a third capacitor coupled between said central strip and ground.

20. The filter of claim 16 wherein said first and second switches are each diodes.

21. The filter of claim 16 wherein said first and second switches are each one of a diode and a transistor.

* * * * *